US008382005B1

(12) United States Patent
Fletcher

(10) Patent No.: US 8,382,005 B1
(45) Date of Patent: Feb. 26, 2013

(54) RIDEABLE TOY

(76) Inventor: Brandon A. Fletcher, Warrensville, OH (US)

( * ) Notice: Subject to any disclaimer, the term of this patent is extended or adjusted under 35 U.S.C. 154(b) by 57 days.

(21) Appl. No.: 13/093,957

(22) Filed: Apr. 26, 2011

(51) Int. Cl.
*E01B 23/00* (2006.01)

(52) U.S. Cl. ..... 238/10 F; 238/10 E; 446/444; 104/53

(58) Field of Classification Search ..... 104/53, 104/56, 77, 78; 472/1, 3, 6, 8, 10, 12, 14, 472/36, 43; 446/431, 433
See application file for complete search history.

(56) References Cited

U.S. PATENT DOCUMENTS 642,435 A * 1/1900 Firnhaber ..... 104/62
2,068,403 A * 1/1937 Ekstrom ..... 104/140
2,318,958 A * 5/1943 Murphy ..... 104/53
3,734,404 A * 5/1973 Baynes et al. ..... 238/10 E
3,871,465 A * 3/1975 Nichols ..... 180/24.02
4,709,958 A * 12/1987 Harrod ..... 296/177
4,795,151 A * 1/1989 Mulcaster ..... 482/68
4,988,143 A * 1/1991 Harrod ..... 296/177
5,016,540 A * 5/1991 Barber ..... 104/53
RE33,769 E * 12/1991 Harrod ..... 296/177
5,232,154 A * 8/1993 Jenkins et al. ..... 238/10 F
5,931,524 A * 8/1999 Jones, Jr. ..... 296/177
6,093,079 A * 7/2000 House ..... 446/444
6,522,244 B2 * 2/2003 Huntsberger et al. ..... 340/425.5
8,141,668 B2 * 3/2012 Huntsberger et al. ..... 180/65.1

* cited by examiner

*Primary Examiner* — Jason C Smith

(57) ABSTRACT

A rideable toy that includes a base that includes a quartet of wheels and a battery-powered motor. The base also has a control pad attached to the motor and a pair of speakers that can be controlled through the control pad. The rideable toy is used in conjunction with a track that is fabricated from a number of track segments that can be interconnected with one another in a wide variety of configurations. Each track segment has placement holes that allow a stop block to be inserted, providing some limitation and perhaps safety considerations to the use of the rideable toy.

7 Claims, 5 Drawing Sheets

RIDEABLE TOY

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of rideable toys are known in the prior art. However, what is needed is a rideable toy that provides a child with a rideable toy that has track mobility within a track that is made from a multitude of interconnected track segments that can be configured into a variety of track shapes.

FIELD OF THE INVENTION

The present invention relates to a rideable toy, and more particularly, to a rideable toy that provides features and characteristics above and beyond existing rideable toys that on which individuals can play.

SUMMARY OF THE INVENTION

The general purpose of the present rideable toy, described subsequently in greater detail, is to provide a rideable toy which has many novel features that result in a rideable toy which is not anticipated, rendered obvious, suggested, or even implied by prior art, either alone or in combination thereof.

To accomplish this, the present rideable toy includes a base that includes a quartet of wheels and a battery-powered motor. The base also has a control pad attached to the motor and a pair of speakers that can be controlled through the control pad. The rideable toy is used in conjunction with a track that is fabricated from a plurality of track segments that can be interconnected with one another in a wide variety of configurations. Each track segment has placement holes that allow a stop block to be inserted, providing some limitation and perhaps safety considerations to the use of the rideable toy.

Thus has been broadly outlined the more important features of the present rideable toy so that the detailed description thereof that follows may be better understood and in order that the present contribution to the art may be better appreciated.

DETAILED DESCRIPTION OF THE DRAWINGS

Figure 1:
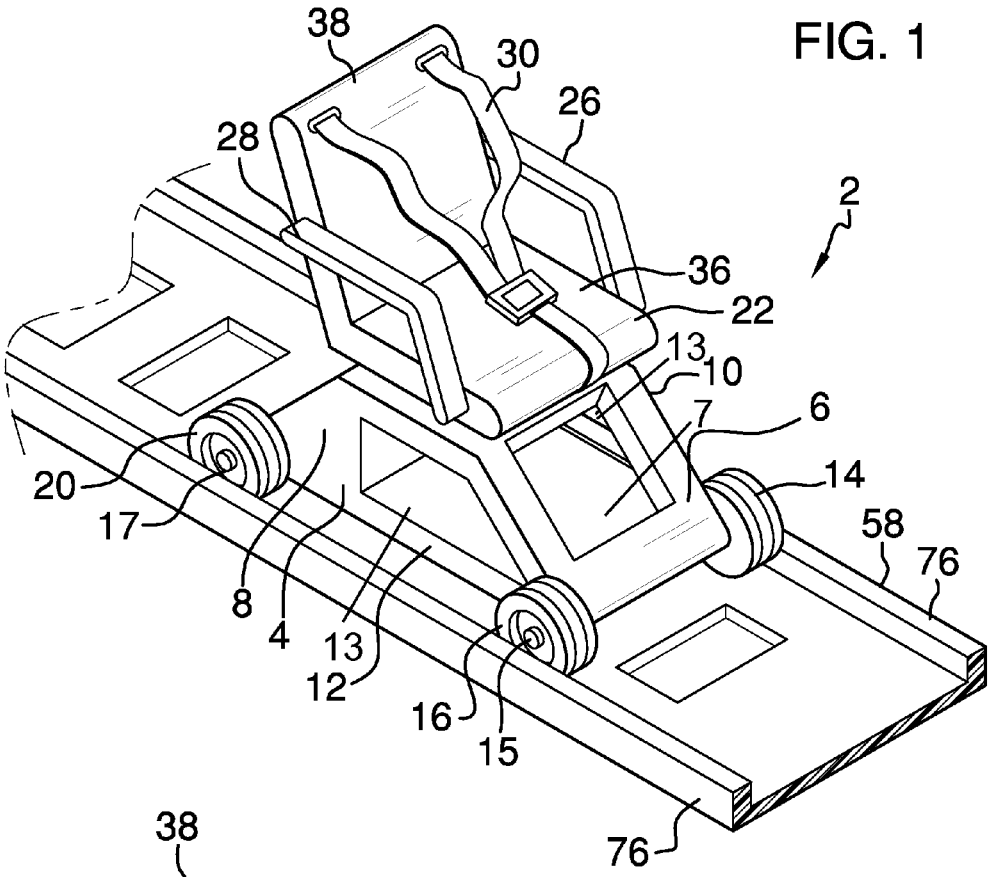
FIG. 1 is an front upper perspective view of the rideable toy as it would appear mounted on a track segment.
Figure 2:
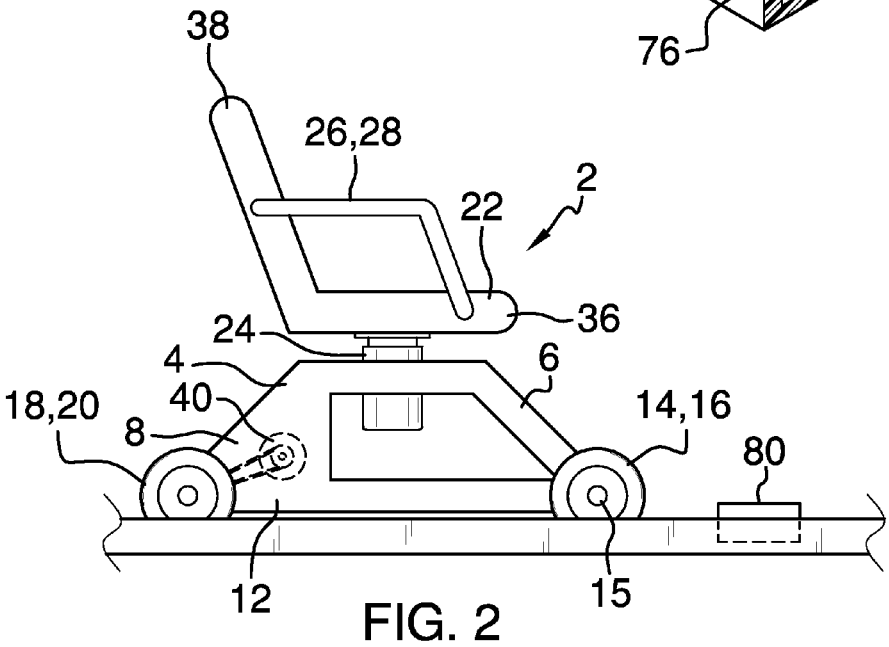
FIG. 2 is a side view of the rideable toy as it would appear mounted on a track segment.
Figure 3:
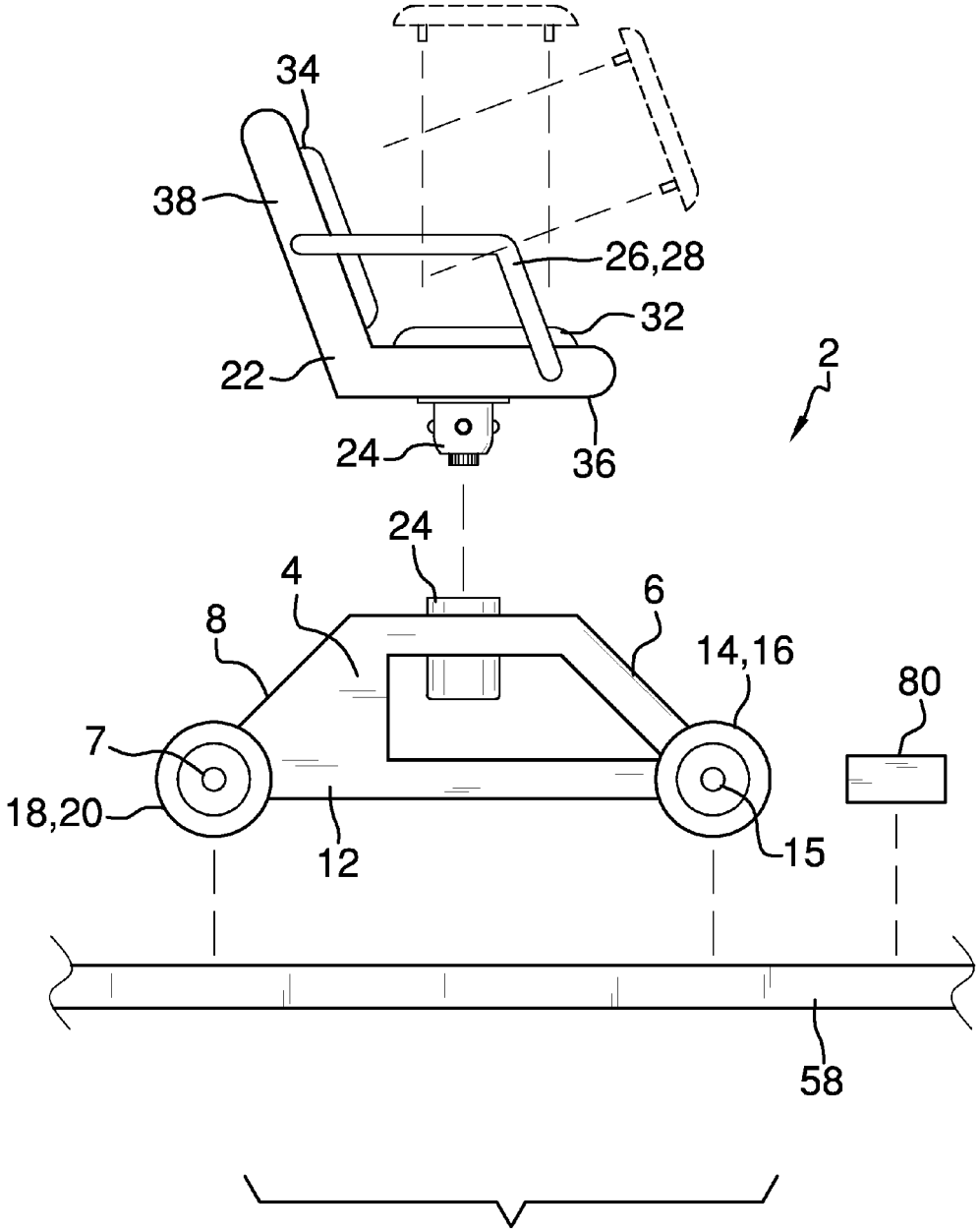
FIG. 3 is a side view of the rideable toy, showing the separate components of the rideable toy after the have pulled apart from one another.
Figure 4:
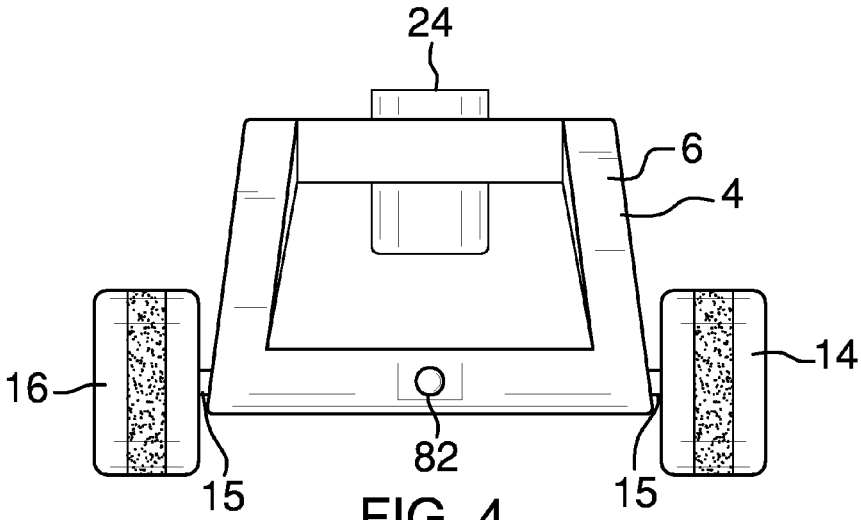
FIG. 4 is a front view of the rideable toy.
Figure 5:
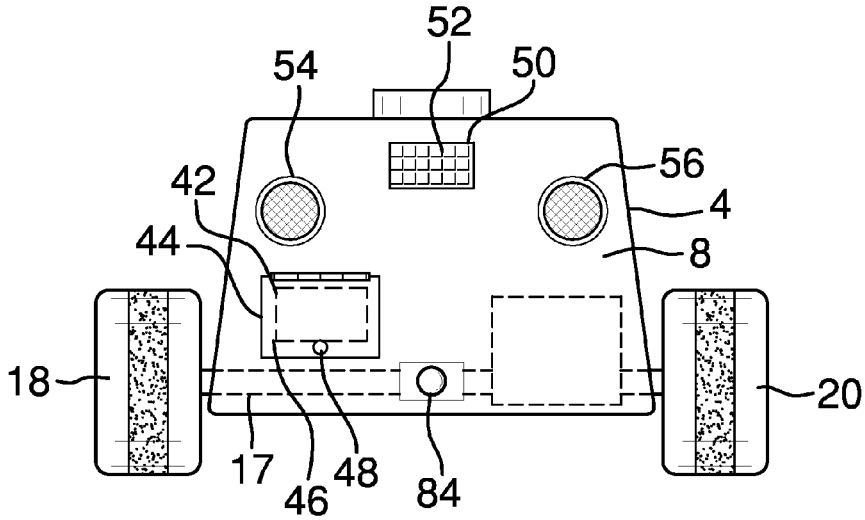
FIG. 5 is a rear view of the rideable toy.

With reference now to the drawings, and in particular FIGS. 1 through 5 thereof, an example of the instant rideable toy employing the principles and concepts of the present rideable toy and generally designated by the reference number 2 will be described.

Figure 6:
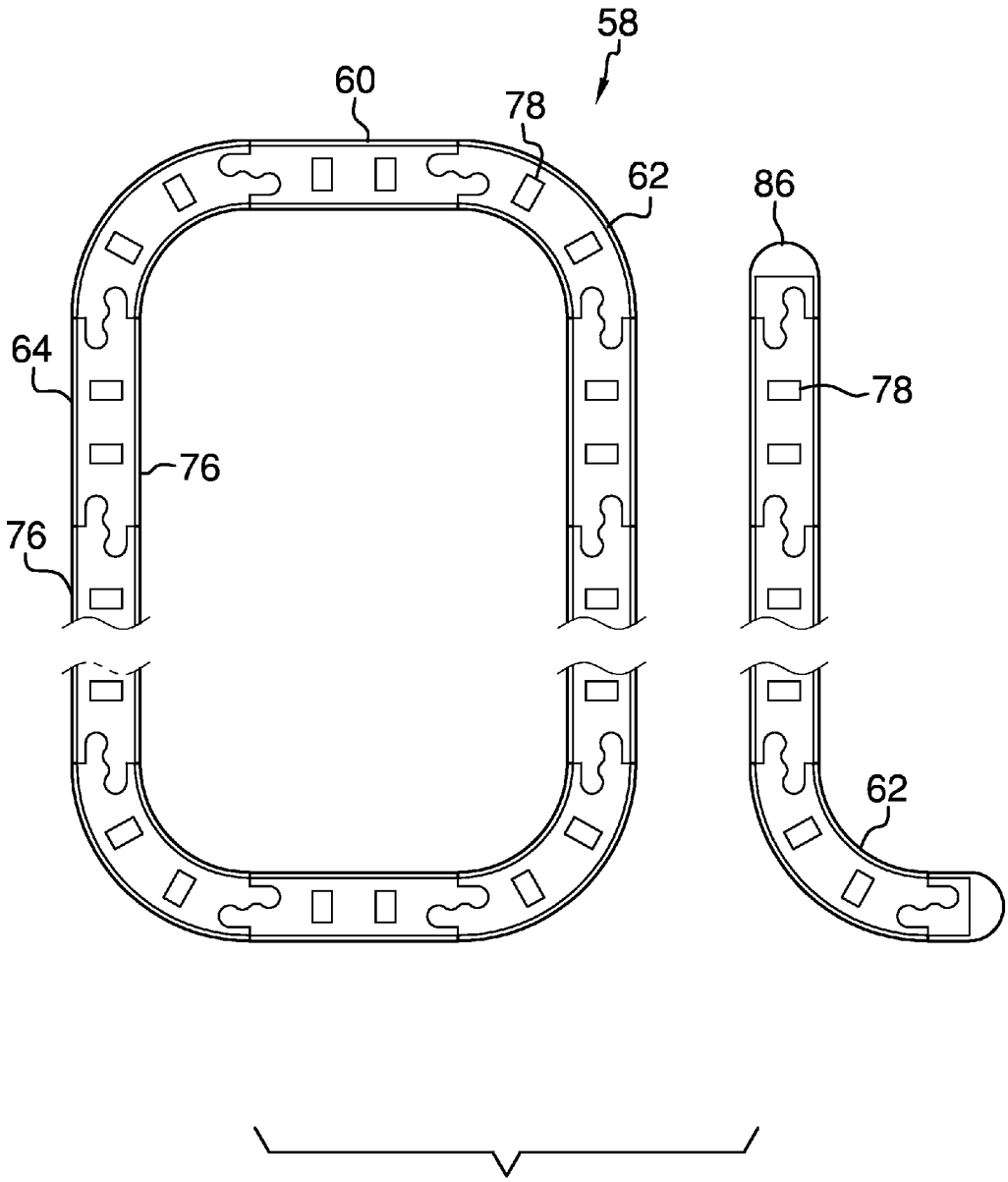
FIG. 6 shows a top view of a plurality of interconnected track segments attached to one another in one possible configuration of the track associated with the rideable toy.
Figure 7:
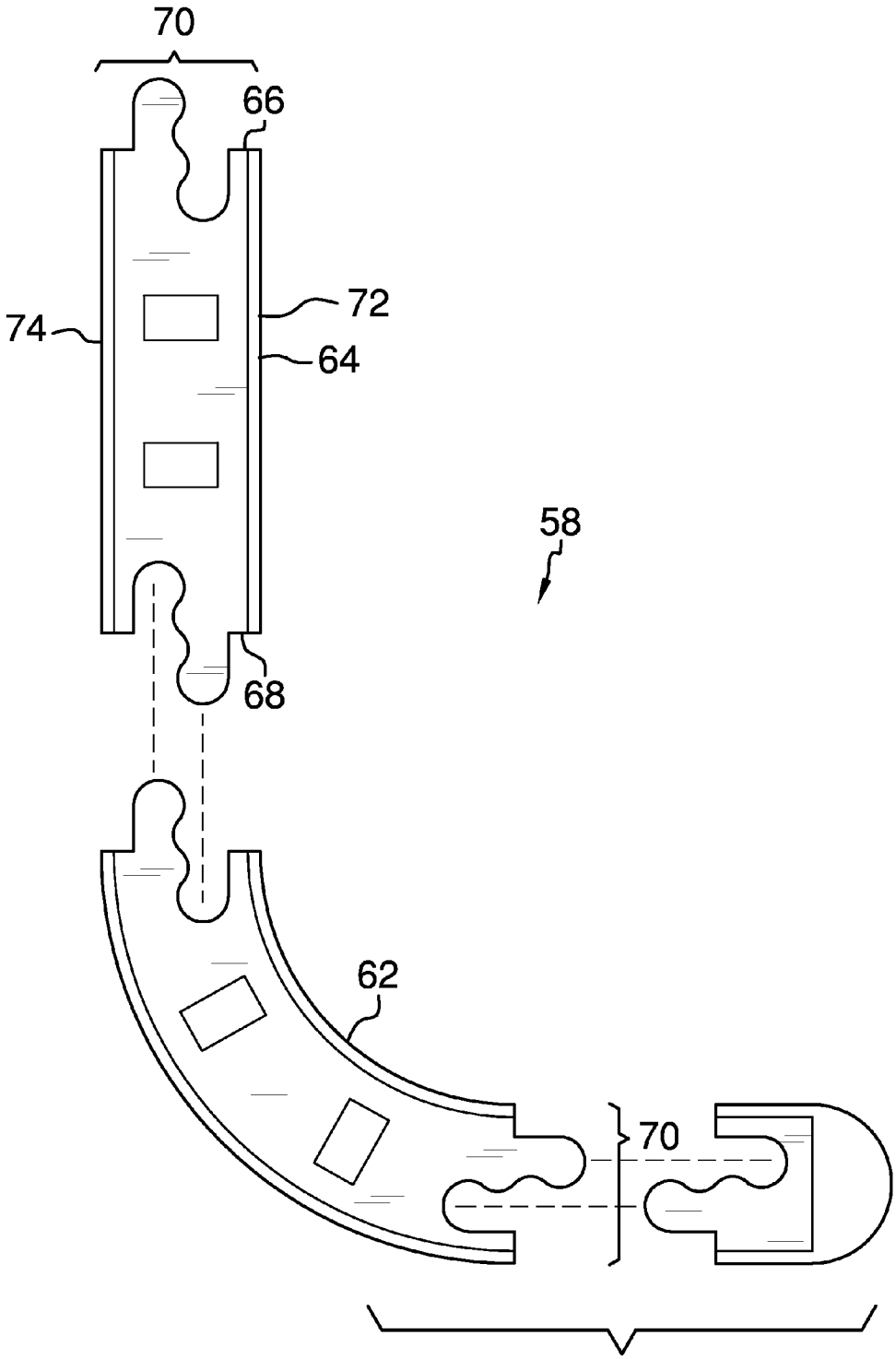
FIG. 7 shows a close-up top view of a few interconnected track segments and highlights how each of the track segments are interconnected to adjoining track segments.

Referring to FIGS. 1 through 7, a preferred embodiment of the present rideable toy 2 is illustrated. The rideable toy 2 includes a base 4 that has two ends comprising a front end 6 and a rear end 8, and furthermore, comprises two sides comprising a left side 10 and a right side 12. The front end 6 has a substantially rectangular cross-section with an opening 7 therein. Each of the left side 10 and the right side 12 has an aperture 13 disposed within a trapezoidal cross-section of the left and right sides 10, 12. Each of the opening 7 and the aperture 13 permit accessibility for repairs and also reduce the weight of the present rideable toy compared to the weight of a solid front end 6 and solid left and right sides 10,12, thus placing less stress on a motor 40 disposed within the base 4.

Rideable toy 2 has a front pair of wheels comprising a left front wheel 14 and a right front wheel 16, with the left front wheel 14 being attached to the left side 10 of the base 4 near the front end 6 of the base 4, while the right front wheel 16 is attached to the right side 12 of the base 4 near the front end 6 of the base 4. Rideable toy 2 also has a rear pair of wheels comprising a left rear wheel 18 and a right rear wheel 20, with the left rear wheel 18 being attached to the left side 10 of the base 4 near the rear end 8 of the base 4, while the right rear wheel 20 is attached to the right side 12 of the base 4 near the front end 6 of the base 4. Left front wheel 14 is connected to right front wheel 16 via front axle 15 which is attached to the base 4, while left rear wheel 18 is connected to right rear wheel 20 via rear axle 17 which is also attached to the base 4.

Base 4 essentially serves as a mount for the seat 22, which is mounted on the base 4 via seat attachment 24, which is connected to the base 4. Seat attachment 24 is cylindrically shaped and allows the seat 22 to swivel atop the base 4 when properly attached. Seat 22 also has a pair of armrests comprising a left armrest 26 and a right armrest 28 and also includes a seat belt mechanism 30 which can be used to removably secure an individual to the seat 22 when the rideable toy 2 is in use.

Seat 22 has optional cushioning pads comprising a bottom seating pad 32 and a back support pad 34, each of which can be attached to the seat 22 as needed. Bottom seating pad 32 is attached to the horizontal portion 36 of the seat 22, while back support pad 34 is attached to the upright portion 38 of the seat 22. Back support pad 38 of the seat 22 is attached to the horizontal portion 36 of the seat 22, with the horizontal portion 36 of the seat 22 being connected to the seat attachment 24.

A motor 40 is located within the base 4 and is connected to rear axle 17. When the motor 40 is operating properly, it will turn the rear axle 17, which will thus propel the rear wheels 18 and 20 forward, causing the entire rideable toy 2 to propel forward. The motor 40 is connected to a battery 42 that is located within a battery compartment 44. The battery compartment 44 is accessible through an external battery compartment door 46 and a handle 48 on the door 46, with the door 46 being pivotally attached to the base 4. The battery compartment 44 can be in any readily accessible location on the base 4 but is preferably near the rear end 8 of the base 4.

A control pad 50 is attached to the base 4, with the control pad 50 being attached to the motor 40. The control pad 50 has a plurality of buttons 52 on it that can be used to control the speed of the motor 40. Furthermore, the rideable toy 2 has a pair of speakers 54 and 56 attached to the base 4, with various buttons 52 on the control pad 50 being used to control volume levels and power for the speakers 54 and 56.

Base also has front reverse button 82 attached to the front end 6 of the base 4, and rear reverse button 84 located on the rear end 8 of the base 4. Both of these buttons 82 and 84 are connected to the control pad 50.

The rideable toy 2 can be used on a track 58, with each track 58 being fabricated from a plurality of track segments 60. Some of the track segments 60 are curved track segments 62, while others are straight track segments 64. In addition, the track 58 utilizes end track segments 86 to "cap off" specific lengths of track 58. Each of the track segments has two ends, a first end 66 and a second end 68, with each end of each track segment having a connector 70 on it. Any particular connector 70 can be removably attached to a connector 70 on any other piece.

Each track segment 60 also has a pair of sides comprising a first side 72 and a second side 74, with each side of each track segment 60 having a raised lip 76. The raised lip 76 prevents the rideable toy 2 from exiting the track 58 when the rideable toy 2 is in use. Each track segment 60 also has at least one hole 78, therein in which a block 80 can be selectively placed. At least one block 80 is provided. A block 80 selectively engages one of the holes 78 to effectively serve as a physical stop for the rideable car 2 when it is operating on the track 58.

What is claimed is:

1. A rideable toy comprising:

a base, the base having two ends comprising a front end and a rear end, the base also having sides comprising a left side and a right side;

a front axle attached to the base;

a pair of front wheels comprising a left front wheel and a right front wheel, wherein the left front wheel is attached to the front axle near the front end of the base on the left side of the base, further wherein the right front wheel is attached to the front axle near the front end of the base on the right side of the base;

a rear axle attached to the base;

a pair of rear wheels comprising a left rear wheel and a right rear wheel, wherein the left rear wheel is attached to the rear axle near the rear end of the base on the left side of the base, further wherein the right rear wheel is attached to the rear axle near the rear end of the base on the right side of the base;

a seat attachment connected to the base;

a seat swivelably connected to the seat attachment, the seat comprising a horizontal portion, the seat further comprising an upright portion, wherein the upright portion is connected to the horizontal portion, further wherein the horizontal portion is connected to the seat attachment;

a bottom seating pad attached to the horizontal portion of the seat;

a back support pad attached to the upright portion of the seat;

a motor located within the base, wherein the motor is connected to the rear axle;

a battery compartment located within the base;

a battery compartment door located on the base, the battery compartment door including a handle, wherein the battery compartment can be accessed through the battery compartment door;

a battery located within the battery compartment, wherein the battery is connected to the motor;

a control pad attached to the base, the control pad further comprising a plurality of buttons, wherein the control pad is connected to the motor;

a track, the track comprising a plurality of track segments, the plurality of track segments comprising a plurality of curved track segments, the plurality of track segments further comprising a plurality of straight track segments, the plurality of track segments further comprising a plurality of end track segments, wherein each track segment comprising two ends comprising a first end and a second end, further wherein each track segment comprises two sides comprising a first side and a second side, wherein each end of track segment has a connector;

wherein the rideable toy is placed on the track;

a plurality of raised lips;

wherein a raised lip is attached to each side of each track segment of the track;

a plurality of holes;

wherein each track segment includes at least one hole of the holes; and at least one block, wherein each block selectively engages one of the holes, wherein each block engaging one of the holes is configured to stop the rideable toy in operation on the track.

2. A rideable toy according to claim 1 wherein the rideable toy further comprises:

a pair of armrests comprising a left armrest and a right armrest;

wherein each of the armrests of the pair of armrests is attached to the seat.

3. A rideable toy according to claim 2 wherein the rideable toy further comprises a seat belt mechanism;

wherein the seat belt mechanism is attached to the seat.

4. A rideable toy according to claim 3 wherein the rideable toy further comprises:

a pair of speakers attached to the base, the pair of speakers further comprising a first speaker and a second speaker;

wherein the control pad is attached to each speaker of the pair of speakers.

5. A rideable toy according to claim 4 wherein the rideable toy further comprises:

a pair of reverse buttons comprising a front reverse button and a rear reverse button wherein the front reverse button is attached to the front end of the base, further wherein the rear reverse button is attached to the rear end of the base, further wherein each of the reverse buttons of the pair of reverse buttons are attached to the control pad.

6. A rideable toy comprising:

a base, the base having two ends comprising a front end and a rear end, the base also having sides comprising a left side and a right side;

a front axle attached to the base;

a pair of front wheels comprising a left front wheel and a right front wheel, wherein the left front wheel is attached to the front axle near the front end of the base on the left side of the base, further wherein the right front wheel is attached to the front axle near the front end of the base on the right side of the base;

a rear axle attached to the base;

a pair of rear wheels comprising a left rear wheel and a right rear wheel, wherein the left rear wheel is attached to the rear axle near the rear end of the base on the left side of the base, further wherein the right rear wheel is attached to the rear axle near the rear end of the base on the right side of the base;

a seat attachment connected to the base;

a seat swivelably connected to the seat attachment, the seat comprising a horizontal portion, the seat further comprising an upright portion, wherein the upright portion is connected to the horizontal portion, further wherein the horizontal portion is connected to the seat attachment, the seat further comprising a seat belt mechanism, wherein the seat belt mechanism is attached to the seat;

a bottom seating pad attached to the horizontal portion of the seat;

a back support pad attached to the upright portion of the seat;

a pair of armrests comprising a left armrest and a right armrest, wherein each of the armrests of the pair of armrests is attached to the seat;

a motor located within the base, wherein the motor is connected to the rear axle;

a battery compartment located within the base;

a battery compartment door located on the base, the battery compartment door including a handle, wherein the battery compartment can be accessed through the battery compartment door;

a battery located within the battery compartment, wherein the battery is connected to the motor;

a control pad attached to the base, the control pad further comprising a plurality of buttons, wherein the control pad is connected to the motor;

a pair of speakers attached to the base, the pair of speakers further comprising a first speaker and a second speaker, wherein the control pad is attached to each speaker of the pair of speakers;

a track, the track comprising a plurality of track segments, the plurality of track segments comprising a plurality of curved track segments, the plurality of track segments further comprising a plurality of straight track segments, the plurality of track segments further comprising a plurality of end track segments, wherein each track segment comprising two ends comprising a first end and a second end, further wherein each track segment comprises two sides comprising a first side and a second side, wherein each end of track segment has a connector;

a plurality of holes, wherein each track segment includes at least one hole of the holes;

at least one block, wherein each block selectively engages one of the holes, wherein each block engaging one of the holes is configured to stop the rideable toy in operation on the track a plurality of raised lips, wherein a raised lip is attached to each side of each track segment of the track;

a pair of reverse buttons comprising a front reverse button and a rear reverse button, wherein the front reverse button is attached to the front end of the base, further wherein the rear reverse button is attached to the rear end of the base, further wherein each of the reverse buttons of the pair of reverse buttons are attached to the control pad; and wherein the rideable toy is configured to be placed on the track.

7. A rideable toy comprising:

a base, the base having two ends comprising a front end and a rear end, the base also having sides comprising a left side and a right side;

wherein the front end has a substantially rectangular cross-section with an opening therein;

wherein each of the left side and the right side has an aperture disposed within a trapezoidal cross-section of the left and right sides;

a front axle attached to the base;

a pair of front wheels comprising a left front wheel and a right front wheel, wherein the left front wheel is attached to the front axle near the front end of the base on the left side of the base, further wherein the right front wheel is attached to the front axle near the front end of the base on the right side of the base;

a rear axle attached to the base;

a pair of rear wheels comprising a left rear wheel and a right rear wheel, wherein the left rear wheel is attached to the rear axle near the rear end of the base on the left side of the base, further wherein the right rear wheel is attached to the rear axle near the rear end of the base on the right side of the base;

a seat attachment connected to the base;

a seat swivelably connected to the seat attachment, the seat comprising a horizontal portion, the seat further comprising an upright portion, wherein the upright portion is connected to the horizontal portion, further wherein the horizontal portion is connected to the seat attachment, the seat further comprising a seat belt mechanism, wherein the seat belt mechanism is attached to the seat;

a bottom seating pad attached to the horizontal portion of the seat;

a back support pad attached to the upright portion of the seat;

a pair of armrests comprising a left armrest and a right armrest, wherein each of the armrests of the pair of armrests is attached to the seat;

a motor located within the base, wherein the motor is connected to the rear axle;

a battery compartment located within the base;

a battery compartment door located on the base, the battery compartment door including a handle, wherein the battery compartment can be accessed through the battery compartment door;

a battery located within the battery compartment, wherein the battery is connected to the motor;

a control pad attached to the base, the control pad further comprising a plurality of buttons, wherein the control pad is connected to the motor;

a pair of speakers attached to the base, the pair of speakers further comprising a first speaker and a second speaker, wherein the control pad is attached to each speaker of the pair of speakers;

a track, the track comprising a plurality of track segments, the plurality of track segments comprising a plurality of curved track segments, the plurality of track segments further comprising a plurality of straight track segments, the plurality of track segments further comprising a plurality of end track segments, wherein each track segment comprising two ends comprising a first end and a second end, further wherein each track segment comprises two sides comprising a first side and a second side, wherein each end of track segment has a connector;

wherein the front wheels and the rear wheels engage the track;

a plurality of holes, wherein each track segment includes at least one hole of the holes;

at least one block, wherein each block selectively engages one of the holes, wherein each block engaging one of the holes is configured to stop the rideable toy in operation on the track;

a plurality of raised lips, wherein a raised lip is attached to each side of each track segment of the track; and a pair of reverse buttons comprising a front reverse button and a rear reverse button, wherein the front reverse button is attached to the front end of the base, further wherein the rear reverse button is attached to the rear end of the base, further wherein each of the reverse buttons of the pair of reverse buttons are attached to the control pad.

* * * * *